US012371806B2

(12) United States Patent
Räisä et al.

(10) Patent No.: US 12,371,806 B2
(45) **Date of Patent: *Jul. 29, 2025**

(54) AQUEOUS ELECTROPLATING BATH

(71) Applicant: Savroc Ltd, Kuopio (FI)

(72) Inventors: Jussi Räisä, Kuopio (FI); Arto Yli-Pentti, Klaukkala (FI)

(73) Assignee: Savroc Ltd, Kuopio (FI)

( * ) Notice: Subject to any disclaimer, the term of this patent is extended or adjusted under 35 U.S.C. 154(b) by 0 days.

This patent is subject to a terminal disclaimer.

(21) Appl. No.: 18/414,020

(22) Filed: Jan. 16, 2024

(65) Prior Publication Data

US 2024/0150919 A1 May 9, 2024

Related U.S. Application Data

(62) Division of application No. 17/996,632, filed as application No. PCT/FI2021/050297 on Apr. 21, 2021, now Pat. No. 12,006,586.

(30) Foreign Application Priority Data

Apr. 23, 2020 (FI) ..... 20205408

(51) Int. Cl.

| | |
|---|---|
| ***C25D 3/06*** | (2006.01) |
| ***C25D 3/10*** | (2006.01) |
| ***C25D 5/00*** | (2006.01) |
| ***C25D 5/14*** | (2006.01) |

(52) U.S. Cl.

CPC ..... *C25D 3/06* (2013.01); *C25D 3/10* (2013.01); *C25D 5/14* (2013.01); *C25D 5/617* (2020.08)

(58) Field of Classification Search

None

See application file for complete search history.

(56) References Cited

U.S. PATENT DOCUMENTS

| | | | | |
|---|---|---|---|---|
| 4,093,521 | A | 6/1978 | Renton et al. | |
| 4,184,929 | A | 1/1980 | Tomaszewski et al. | |
| 4,690,735 | A | 9/1987 | Laitinen et al. | |
| 5,415,763 | A | 5/1995 | Johnson et al. | |
| 5,759,243 | A | 6/1998 | Johnson | |
| 6,329,071 | B1 | 12/2001 | Kobayashi et al. | |
| 7,052,592 | B2 | 5/2006 | Edigaryan | |
| 11,785,559 | B2 | 10/2023 | Räisäet al. | |
| 11,795,559 | B2 | 10/2023 | Räisäet al. | |
| 12,006,586 | B2 | 6/2024 | Räisäet al. | |
| 2008/0169199 | A1 | 7/2008 | Huang et al. | |
| 2009/0114544 | A1 | 5/2009 | Rousseau | |
| 2015/0361571 | A1 | 12/2015 | Miettinen et al. | |
| 2016/0068983 | A1 | 3/2016 | Schulz et al. | |
| 2016/0318282 | A1 | 11/2016 | Muchtar et al. | |
| 2017/0009361 | A1 | 1/2017 | Dal Zilio | |
| 2017/0159198 | A1 | 6/2017 | Miettinen | |
| 2019/0040540 | A1 | 2/2019 | Raisa | |
| 2019/0309430 | A1 | 10/2019 | Sklar | |
| 2021/0017659 | A1 | 1/2021 | Ijeri et al. | |
| 2021/0348291 | A1* | 11/2021 | Rüther | C25D 9/08 |
| 2023/0127810 | A1 | 4/2023 | Räisäet al. | |
| 2023/0129051 | A1 | 4/2023 | Räisäet al. | |
| 2023/0145456 | A1 | 5/2023 | Räisäet al. | |
| 2023/0193495 | A1 | 6/2023 | Räisäet al. | |

FOREIGN PATENT DOCUMENTS

| | | |
|---|---|---|
| CN | 101392394 | 3/2009 |
| CN | 101410556 | 4/2009 |
| CN | 102433574 | 5/2012 |
| CN | 102383149 | 7/2014 |
| CN | 102925934 | 10/2015 |
| CN | 105297084 | 11/2018 |
| CN | 109537002 | 3/2019 |
| EP | 0073221 | 3/1983 |
| EP | 2957660 | 12/2015 |
| EP | 2980280 | 2/2016 |
| FR | 2331628 | 6/1977 |
| GB | 1482747 | 8/1977 |
| GB | 1592761 | 7/1981 |
| JP | 60152694 | 8/1985 |
| JP | 2010084224 | 4/2010 |
| JP | 2019026889 | 2/2019 |
| RU | 2139369 | 10/1999 |
| WO | 1982003095 | 9/1982 |

(Continued)

OTHER PUBLICATIONS

"EP Application No. 21791910.9 Extended European Search Report", Sep. 5, 2024, 7 pages.

"CN Application No. 202180030113.4, Office Action", Jan. 2, 2024, 12 pages.

"U.S. Appl. No. 17/996,521 Office Action", Mar. 22, 2024, 7 pages.

"EP Application No. EP21792683.1 Extended European Search Report", Jun. 27, 2024, 5 pages.

"Extended European Search Report for EP 21 79 2565", Jun. 4, 2024, 6 pages.

"AU Application No. 2021260899 Office Action", Nov. 25, 2022, 3 pages.

(Continued)

*Primary Examiner* — Wojciech Haske

(74) *Attorney, Agent, or Firm* — DeLizio, Peacock, Lewin & Guerra LLP

(57) ABSTRACT

An object comprising a chromium-based coating on a substrate is disclosed, wherein the chromium is electroplated from an aqueous electroplating bath comprising trivalent chromium cations, wherein the chromium-based coating comprises 87-98 weight-% of chromium, 0.3-5 weight-% of carbon, and 0.1-11 weight-% of nickel and/or iron, and wherein the chromium-based coating has a Vickers microhardness value of 1000-2000 HV, and wherein the chromium-based coating does not contain chromium carbide. Further is disclosed a method for its production, and an aqueous electroplating bath.

11 Claims, No Drawings

(56) References Cited

FOREIGN PATENT DOCUMENTS

| | | |
|---|---|---|
| WO | 2016044708 | 3/2016 |
| WO | 2021214389 | 10/2021 |
| WO | 2021214390 | 10/2021 |
| WO | 2021214391 | 10/2021 |
| WO | 2021214392 | 10/2021 |

OTHER PUBLICATIONS

"CN Application No. 202180030113.4 Office Action", Apr. 17, 2023, 17 pages.
"CN Application No. 202180030423.6 Office Action", May 23, 2023, 12 pages.
"FI Search Report for 20205408", Oct. 2, 2020, 1 page.
"PCT/FI2021/050298 International Search Report and Written Opinion", Jul. 12, 2021, 11 pages.
"PCT/FI2021/050299 International Preliminary Report on Patentability", Jun. 10, 2020, 21 pages.
"PCT/FI2021/050299 International Search Report and Written Opinion", Jul. 15, 2021, 10 pages.
"PCT/FI2021/050300 International Preliminary Report on Patentability 2022 06 10", Jun. 10, 2022, 26 pages.
"PCT/FI2021/050300 International Search Report & Written Opinion 2021 07 13", Jul. 13, 2021, 12 pages.
"PCTFI20211050297 International Search Report and Written Opinion 2022 06 30", Jun. 30, 2021, 15 pages.
"Standard Guide for Conducting Wear Tests Using a Rotary Platform Abraser", ASTM International G195-18, Jan. 1, 2018, 10 pages.
"U.S. Appl. No. 17/996,632 Office Action", Mar. 16, 2023, 8 pages.
"U.S. Appl. No. 17/996,632 Office Action", May 10, 2023, 10 pages.
"U.S. Appl. No. 17/919,688 Office Action", Mar. 13, 2023, 7 pages.
"U.S. Appl. No. 17/996,521 Office Action", Nov. 15, 2023, 10 pages.
"U.S. Appl. No. 17/996,521 Office Action", May 10, 2023, 11 pages.
"U.S. Appl. No. 17/996,632 Final Office Action", Nov. 16, 2023, 5 pages.
"U.S. Appl. No. 17/996,642 Office Action", Mar. 29, 2023, 6 pages.
Benaben, "Thick, Hard Electrodeposits From a Trivalent Chromium Bath", Electroplaters Society,Inc., East Orange, US, vol. 76, No. 11,Nov. 1, 1989 (Nov. 1, 1989), pp. 60-63, XP000083921, ISSN: 0360-3164, table 2 p. 61, left-hand column, paragraph 3rd, Nov. 1, 1989, 4.
Huang, et al., "Anneal-hardening behaviour of CrC, CrNiC and CrNiFeC alloy deposits", Journal of the Taiwan Institute of Chemical Engineers, vol. 96, Mar. 1, 2019 (Mar. 1, 2019), pp. 543-548, XP085614485, ISSN: 1876-1070, DOI: 10.1016/J.JTICE.2018.11.005, Mar. 1, 2019, 6.
Huang, et al., "Microstructure and electrochemical corrosion behavior of Cr—Ni—Fe alloy deposits electroplated in the presence of trivalent Cr ions", Thin Solid Films, vol. 544, Oct. 1, 2013 (Oct. 1, 2013), pp. 69-73, P055316775, Amsterdam, NL ISSN: 0040-6090, DOI: 10.1016/j.tsf.2013.04.124 Section 4: Conclusion, Oct. 1, 2013, 5.
Oduoza, et al., "Chromium Electroplating of Aluminium Alloys Using Electroless Nickel as Underlayer", Journal of Materials Science and Chemical Engineering, 20140101—ISSN 2327-6045, vol. 2, Nr:7, pp. 59-74, Jul. 1, 2014, 17.
"CN Application No. 202180030405.8 First Office Action", Dec. 9, 2024, 12 pages.

* cited by examiner

AQUEOUS ELECTROPLATING BATH

TECHNICAL FIELD

The present disclosure relates to an object comprising a chromium-based coating on a substrate. The present disclosure further relates to a method for producing an object comprising a chromium-based coating on a substrate. The present disclosure further relates to an aqueous electroplating bath.

BACKGROUND

Objects which are utilized in demanding environmental conditions often require e.g. mechanical or chemical protection, so as to prevent the environmental conditions from affecting the object. Protection to the object can be realized by applying a coating thereon, i.e. on the substrate. Disclosed are protective coatings for various purposes; hard-coatings that protect the substrate from mechanical effects and diffusion barriers for protection against chemical effects. However, further manners to produce hard-coatings in an environmentally friendly manner are needed.

SUMMARY

An object comprising a chromium-based coating on a substrate is disclosed. The chromium may be electroplated from an aqueous electroplating bath comprising trivalent chromium cations. The chromium-based coating may comprise 87-98 weight-% of chromium, 0.3-5 weight-% of carbon, and 0.1-11 weight-% of nickel and/or iron. The chromium-based coating may have a Vickers microhardness value of 900-2000 HV. The chromium-based coating does not contain chromium carbide.

An object comprising a chromium-based coating on a substrate is disclosed. The chromium may be electroplated from an aqueous electroplating bath comprising trivalent chromium cations. The chromium-based coating may comprise 87-98 weight-% of chromium, 0.3-5 weight-% of carbon, and 0.1-11 weight-% of nickel and/or iron. The chromium-based coating may have a Vickers microhardness value of 1000-2000 HV. The chromium-based coating does not contain chromium carbide.

Further is disclosed a method for producing an object comprising a chromium-based coating on a substrate. The method may comprise:

- depositing a chromium-containing layer on the substrate by subjecting the substrate to at least one electroplating cycle from an aqueous electroplating bath, wherein the electroplating cycle is carried out at a current density of 50-300 A/dm2 and at a deposition rate of 1.5-10 lam/minute, and wherein the aqueous electroplating bath comprises:
- trivalent chromium cations in an amount of 0.12-0.3 mol/l,
- iron cations and/or nickel cations in an amount of 0.18-6.16 mmol/l, and carboxylate ions in an amount of 1.22-7.4 mol/l, and
  - wherein the molar ratio of trivalent chromium cations to the carboxylate ions is 0.015-0.099, and wherein the pH of the aqueous trivalent chromium bath is 2-6,
- to produce a hard chromium-based coating having a Vickers microhardness value of 900-2000 HV without subjecting the deposited chromium-containing layer to a heat treatment.

Further is disclosed an aqueous electroplating bath. The aqueous electroplating bath may comprise:

- trivalent chromium cations in an amount of 0.12-0.3 mol/l,
- iron cations and/or nickel cations in an amount of 0.18-6.16 mmol/l, and
- carboxylate ions in an amount of 1.22-7.4 mol/l, and
  - wherein the molar ratio of trivalent chromium cations to the carboxylate ions is 0.015-0.099, and wherein the pH of the aqueous trivalent chromium bath is 2-6.

Further is disclosed an aqueous electroplating bath. The aqueous trivalent chromium bath may comprise:

- trivalent chromium cations in an amount of 0.12-0.3 mol/l,
- iron cations and/or nickel cations in an amount of 0.18-6.16 mmol/l, and
- carboxylate ions in an amount of 1.2-7.4 mol/l, and
  - wherein the molar ratio of trivalent chromium cations to the carboxylate ions is 0.015-0.099, wherein the pH of the aqueous trivalent chromium bath is 2-6; and wherein the conductivity of the aqueous electroplating bath is 160-400 mS/cm.

DESCRIPTION

The present disclosure relates to an object comprising a chromium-based coating on a substrate. The chromium may be electroplated from an aqueous electroplating bath comprising trivalent chromium cations. The chromium-based coating may comprise 87-98 weight-% of chromium, 0.3-5 weight-% of carbon, and 0.1-11 weight-% of nickel and/or iron. The chromium-based coating may have a Vickers microhardness value of 900-2000 HV. The chromium-based coating may not contain chromium carbide.

The present disclosure relates to an object comprising a chromium-based coating on a substrate. The chromium may be electroplated from an aqueous electroplating bath comprising trivalent chromium cations. The chromium-based coating may comprise 87-98 weight-% of chromium, 0.3-5 weight-% of carbon, and 0.1-11 weight-% of nickel and/or iron. The chromium-based coating may have a Vickers microhardness value of 1000-2000 HV. The chromium-based coating does not contain chromium carbide. As is clear to the skilled person, the total amount of the different elements in the chromium-based coating may not exceed 100 weight-%. The amount in weight-% of the different elements in the chromium-based coating may vary between the given ranges.

The present disclosure further relates to a method for producing an object comprising a chromium-based coating on a substrate. The method may comprises:

- depositing a chromium-containing layer on the substrate by subjecting the substrate to at least one electroplating cycle from an aqueous electroplating bath, wherein each of the at least one electroplating cycles is carried out at a current density of 50-300 A/dm2 and at a deposition rate of 1.5-10 lam/minute, and wherein the aqueous electroplating bath comprises
- trivalent chromium cations in an amount of 0.12-0.3 mol/l,
- iron cations and/or nickel cations in an amount of 0.18-6.16 mmol/l, and carboxylate ions in an amount of 1.22-7.4 mol/l, and
  - wherein the molar ratio of trivalent chromium cations to the carboxylate ions is 0.015-0.099, and wherein the pH of the aqueous trivalent chromium bath is 2-6, to produce a hard chromium-based coating having a Vickers microhardness value of 900-2000 HV without subjecting the deposited chromium-containing layer to a heat treatment.

In one embodiment, the method for producing an object comprising a chromium-based coating on a substrate comprises producing the object comprising a chromium-based coating on a substrate as defined in the current specification.

The present disclosure relates to an aqueous electroplating bath. The aqueous electroplating bath may comprise:

trivalent chromium cations in an amount of 0.12-0.3 mol/l, iron cations and/or nickel cations in an amount of 0.18-6.16 mmol/l, and carboxylate ions in an amount of 1.22-7.4 mol/l, and wherein the molar ratio of trivalent chromium cations to the carboxylate ions is 0.015-0.099, and wherein the pH of the aqueous trivalent chromium bath is 2-6.

The present disclosure relates to an aqueous electroplating bath. The aqueous trivalent chromium bath may comprise:

trivalent chromium cations in an amount of 0.12-0.3 mol/l, iron cations and/or nickel cations in an amount of 0.18-6.16 mmol/l, and carboxylate ions in an amount of 1.2-7.4 mol/l, and wherein the molar ratio of trivalent chromium cations to the carboxylate ions is 0.015-0.099, wherein the pH of the aqueous trivalent chromium bath is 2-6; and wherein the conductivity of the aqueous electroplating bath is 160-400 mS/cm.

The inventor surprisingly found out that it is possible to produce a hard chromium-based coating having a Vickers microhardness value of 900-2000 HV without the use of a heat treatment of the chromium-containing layer deposited from the electroplating bath by using the aqueous electroplating bath as disclosed in the current specification. The expression "heat treatment" should be understood in this specification, unless otherwise stated, as referring to subjecting the deposited chromium-containing layer to a heat treatment at a temperature of 300-1200° C. for a period of time that would result in the formation of chromium carbides in the chromium-based coating. Such a heat treatment may further change the crystalline structure of chromium. I.e. the method for producing the chromium-based coating may comprise the provision that the deposited chromium-containing layer is not subjected to a heat treatment to form a chromium-based coating having a Vickers microhardness value of 900-2000 HV. This provision may not, however, exclude e.g. dehydrogenation annealing.

In one embodiment, the chromium-based coating has a Vickers microhardness value of 1000-1900 HV, or 1100-1800 HV, or 1200-1700 HV, or 1300-1600 HV, or 1400-1500 HV. The Vickers microhardness may be determined according to standard ISO 14577-1:2015.

In one embodiment, the chromium-based coating may have a Taber index of below 1.5 mg/1000 RPM, or below 1.3 mg/1000 RPM, or below 1.2 mg/1000 RPM, or below 1.1 mg/1000 RPM as determined according to ASTM G195-18 (wheel CS10, 1000 g). Taber index indicates the wear resistance of the chromium-based coating. The smaller the value of the Taber index is, the better is the wear resistance of the chromium-based coating.

In one embodiment, the crystal size of the chromium may be 7-40 nm, or 9-20 nm, or 11-16 nm. The crystal size of the chromium may be determined in the following manner:

Samples are measured with X-ray diffraction (XRD) in a Grazing incidence (GID) geometry. In GID-geometry the X-rays are targeted on the sample with a small incident angle and held constant during the measurement. In this way, the X-rays can be focused on the surface layers of the sample, with the purpose of minimizing the signal from the substrate. The measurements are performed on a 20 angular range of 30°-120°, with increments of 0.075°. A total measurement time for each sample is 1 h. The incident angle of X-rays is 4°. In addition to the samples, a corundum sample was measured with identical setup to measure the instrumental broadening of diffraction peaks. The measurements are performed on a Bruker D8 DISCOVER diffractometer equipped with a Cu Kα X-ray source. The X-rays are parallelized with a Göbel minor, and are limited on the primary side with a 1 mm slit. An equatorial soller slit of 0.2° is used on the secondary side. The phases from the samples are identified from the measured diffractograms with DIFFRAC.EVA 3.1 software utilizing PDF-2 2015 database. The crystallite sizes and lattice parameters are determined from the samples by full profile fitting performed on TOPAS 4.2 software. The instrumental broadening is determined from the measurement of the corundum sample. The crystallite sizes are calculated using the Scherrer equation [see Patterson, A. (1939). "The Scherrer Formula for X-Ray Particle Size Determination". Phys. Rev. 56 (10): 978-982], where the peak widths are determined with the integral breadth method [see Scardi, P., Leoni, M., Delhez, R. (2004). "Line broadening analysis using integral breadth methods: A critical review". J. Appl. Crystallogr. 37: 381-390]. The obtained values for lattice parameters are compared to literature values from PDF-2 2015 database. The difference in measured values and literature values suggest the presence of residual stress within the coating.

In one embodiment, the chromium-based coating comprises 87-98 weight-%, or 92-97 weight-% of chromium. In one embodiment, the chromium-based coating comprises 0.3-5 weight-%, or 1.0-3.0 weight-% of carbon. In one embodiment, the chromium-based coating comprises 0.1-11 weight-% of nickel and/or iron, or 1.1-8.2 weight-% of nickel and/or iron, or 1.5-6.2 weight-% of nickel and/or iron. I.e. the total amount of nickel and/or iron in the chromium-based coating may be 0.1-11 weight-%, or 1.1-8.2 weight-%, or 1.5-6.2 weight-%. In one embodiment, the chromium-based coating comprises 0-6 weight-%, or 0.1-5 weight-%, or 0.5-3.0 weight-% of nickel. In one embodiment, the chromium-based coating comprises 0.1-5 weight-%, or 1.0-3.2 weight-%, of iron.

The amounts of different elements, such a chromium, iron, and nickel, in the chromium-based coating may be measured and determined with an XRF analyzer. The amount of carbon in the chromium-based coating may be measured and determined with an infrared (IR) detector. An example of such a detector is the Leco C230 carbon detector.

The chromium-based coating may comprise also other elements. The chromium-based coating may in addition comprise oxygen and/or nitrogen.

Usually, in order to achieve hard chromium-based coatings with a Vickers microhardness value of at least 900 HV, may have required the use of at least one heat treatment of the deposited chromium-containing layer at a temperature of 300-1200° C., when using an aqueous electroplating bath in which chromium is present substantially only in the trivalent form. The inventor surprisingly found out that such a heat treatment may be omitted from the method when using the aqueous electroplating bath as defined in the current specification. By omitting this kind of heat treatment, one may be able to form a chromium-based coating that essentially lacks chromium carbides. The term "chromium carbide" is herein to be understood to include all the chemical compositions of chromium carbide. Examples of chromium carbides that may be present in the first layer are Cr3C2, Cr7C3, Cr23C6, or any combination of these. Such chromium carbides are usually formed into the chromium-based coating when the chromium-containing layer deposited on a substrate by electroplating from a trivalent chromium bath is subjected to at least one heat treatment at the temperature of 300-1200° C.

In this specification, unless otherwise stated, the terms "electroplating", "electrolytic plating" and "electrodeposition" are to be understood as synonyms. By depositing a chromium-containing layer on the substrate is herein meant depositing a layer directly on the substrate to be coated. In the present disclosure, the chromium-containing layer may be deposited through electroplating from an aqueous electroplating bath comprising trivalent chromium cations. In this connection, the wording electroplating "from an aqueous electroplating bath comprising trivalent chromium cations" is used to define a process step in which the deposition is taking place from an electrolytic bath in which chromium is present substantially only in the trivalent form.

As presented in the current specification, the aqueous electroplating bath may comprise:

- trivalent chromium cations in an amount of 0.12-0.3 mol/l,
- iron cations and/or nickel cations in an amount of 0.18-6.16 mmol/l,
- carboxylate ions in an amount of 1.22-7.4 mol/l.

The molar ratio of trivalent chromium cations to the carboxylate ions is 0.015-0.099 in the aqueous electroplating bath. In one embodiment, the molar ratio of trivalent chromium cations to the carboxylate ions is 0.015-0.09, 0.03-0.08, or 0.065-0.075. The inventor surprisingly found out that the specified molar ratio of the trivalent chromium cations to the carboxylate ions has the added utility of enabling to omit the usually required heat treatment of the deposited chromium-containing layer to achieve a hard chromium-based coating.

Any soluble trivalent chromium salt(s) may be used as the source of the trivalent chromium cations. Examples of such trivalent chromium salts are potassium chromium sulfate, chromium(III)acetate, and chromium(III)chloride.

In one embodiment, the source of carboxylate ions is a carboxylic acid. In one embodiment, the source of the carboxylate ions is formic acid, acetic acid, or citric acid. In one embodiment, the source of the carboxylate ions is formic acid. In one embodiment, the source of the carboxylate ions is formic acid together with acetic acid and/or citric acid.

In one embodiment, the aqueous electroplating bath comprises trivalent chromium cations in an amount of 0.13-0.24 mol/l, or 0.17-0.21 mol/l.

The aqueous electroplating bath contains iron cations and/or nickel cations. The inventors surprisingly found that said cations may be needed in order to deposit the chromium-containing layer. The nickel ions may have the added utility of decreasing the potential needed in voltammetry. In one embodiment, the aqueous electroplating bath comprises iron cations in an amount of 0.18-3.6 mmol/l, or 0.23-0.4 mmol/l. In one embodiment, the aqueous electroplating bath comprises nickel cations in an amount of 0.0-2.56 mmol/l, or 0.53-1.2 mmol/l. In one embodiment, the aqueous electroplating bath comprises iron cations and nickel cations in an amount of 0.18-6.16 mmol/l, or 0.76-1.6 mmol/l. In one embodiment, the aqueous electroplating bath comprises iron cations but not nickel cations. In one embodiment, the aqueous electroplating bath comprises nickel cations but not iron cations. In one embodiment, the aqueous electroplating bath comprises both iron cations and nickel cations.

In one embodiment, the aqueous electroplating bath comprises carboxylate ions in an amount of 2.0-6.0 mol/l, or 2.3-3.2 mol/l.

In one embodiment, the aqueous electroplating bath comprises a bromide ions in an amount of 0.15-0.3 mol/l, 0.21-0.25 mol/l. In one embodiment, the source of the bromide ions is selected from a group consisting of potassium bromide, sodium bromide, ammonium bromide, and any combination or mixture thereof. In one embodiment, the source of the bromide ions is potassium bromide, sodium bromide, or ammonium bromide. The use of the bromide, such as potassium bromide, may have the added utility of efficiently preventing the formation of hexavalent chromium at the anode of the electroplating system.

In one embodiment, the aqueous electroplating bath comprises ammonium ions in an amount of 2-10 mol/l, or 2.5-6 mol/l, or 3-3.4 mol/l. In one embodiment, the aqueous electroplating bath comprises ammonium ions in an amount of 0.18-1.5 mol/l, or 0.45-1.12 mol/l. The use of ammonium ions have the added utility of providing conductance to the aqueous electroplating bath. The use of ammonium ions have the added utility of forming a complex with the chromium. In one embodiment, the source of the ammonium ions is selected from a group consisting of ammonium chloride, ammonium sulfate, ammonium formate, ammonium acetate, and any combination or mixture thereof In one embodiment, the pH of the aqueous electroplating bath may be 2-6, or 3-5.5, or 4.5-5, or 4.1-5. The pH may be adjusted by including a base in the aqueous electroplating bath when needed Ammonium hydroxide, sodium hydroxide, and potassium hydroxide may be mentioned as examples of bases that may be used for adjusting the pH of the aqueous electroplating bath. In one embodiment, the aqueous electroplating bath comprises ammonium hydroxide, sodium hydroxide, and/or potassium hydroxide. In one embodiment, the aqueous electroplating bath comprises a base in an amount of 0.5-3.1 mol/l, or 1.4-1.8 mol/l.

In one embodiment, the conductivity of the aqueous electroplating bath is 160-400 mS/cm, 200-350 mS/cm, or 250-300 mS/cm. The conductivity of the aqueous electroplating bath may be adjusted with the use of e.g. different salts for conductivity. Ammonium chloride, potassium chloride, and sodium chloride can be mentioned as examples of salts that may be used to adjust the conductivity. The conductivity may be determined e.g. in compliance with standard EN 27888 (water quality; determination of electrical conductivity (ISO 7888:1985)).

As is clear to the skilled person, the chromium-based coating may in addition to the materials presented above contain minor amounts of residual elements and/or compounds originating from manufacturing process, such as the electroplating process. Examples of such further elements are copper (Cu), zinc (Zn), and any compounds including the same.

The method and the chromium-based coating as disclosed in the current specification are well suited for protecting metal substrates from corrosion. In one embodiment, the corrosion resistance of the object is at least 24 h, or at least 48 h, or at least 96 h, or at least 168 h, or at least 240 h, or at least 480 h. The corrosion resistance can be determined in accordance with standard EN ISO 9227 NSS (neutral salt spray) rating 9 or 10 (2017).

The thickness of the chromium-based coating can vary depending on the application where the object is to be used.

The thickness of the chromium-based coating may depend on the number and thickness of the layers it comprises. In on embodiment, the thickness of the chromium-based coating is 0.05-200 lam, or 0.5-100 lam, or 0.3-5 μm.

By a "substrate" is herein meant any component or body on which the chromium-based coating according to the present disclosure is coated on. Generally, the chromium-based coating according to the present disclosure can be used on variable substrates. In one embodiment, the substrate comprises or consists of metal, a combination of metals, or a metal alloy. In one embodiment, the substrate is made of steel, copper, nickel, iron, or any combination thereof. The substrate can be made of ceramic material. The substrate does not need to be homogenous material. In other words, the substrate may be heterogeneous material. The substrate can be layered. For example, the substrate can be a steel object coated by a layer of nickel, or nickel phosphorus alloy (Ni—P). In one embodiment, the substrate is a cutting tool, for example a cutting blade. In one embodiment, the substrate is a cutting tool comprising metal.

In one embodiment, the object comprising a chromium-based coating on a substrate does not comprise a layer of nickel. In one embodiment, the chromium-based coating does not comprise a layer of nickel. In one embodiment, the substrate does not comprise a layer of nickel.

In one embodiment, the object is a gas turbine, shock absorber, hydraulic cylinder, linked pin, joint pin, a bush ring, a round rod, a valve, a ball valve, or an engine valve.

In one embodiment, depositing the chromium-containing layer by subjecting the substrate to at least one electroplating cycle comprises subjecting the substrate to one, two, three, four, five, six, seven, eight, nine, or ten electroplating cycles. Each of the at least one electroplating cycles may be continued for 1 minute-4 hours, or 10-60 minutes, or 20-40 minutes, or for about 30 minutes. Each of the at least one electroplating cycles may be carried out at a current density of 50-300 A/dm2, or 80-250 A/dm2, or 110-200 A/dm2, or 120-180 A/dm2, or 130-170 A/dm2, or 140-150 A/dm2. The temperature of the aqueous electroplating bath may be kept at 25-70° C., or 40-50° C. during the electroplating cycle(s). In one embodiment, the each of the at least one electroplating cycles is carried out at a deposition rate of 1.8-5 lam/minute, or 2.0-4 μm/minute, or 2.5-3.5 μm/minute.

Each of the at least one electroplating cycles may be separated from another electroplating cycle in time so as to form at least two sublayers arranged one upon the other. In one embodiment, each of the electroplating cycles is separated from one another in time by stopping the electroplating process for a predetermined period of time. Each of the at least two electroplating cycles is separated from another electroplating cycle by at least 1 second, or at least 10 seconds, or at least 30 seconds, or at least 1 minute, or at least 5 minutes, or at least 10 minutes. In one embodiment, each of the at least two electroplating cycles is separated from another electroplating cycle by 0.1 milliseconds-3 minutes, or 1 second-60 seconds, or 10-30 seconds. In one embodiment, each of the at least two electroplating cycles is separated from another electroplating cycle by 0.5-10 minutes, or 2-8 minutes, or 3-7 minutes.

Different electroplating cycles may be separated from each other by stopping the current to pass through the aqueous electroplating bath. The substrate to be subjected to the electroplating may be removed from the aqueous electroplating bath for a certain period of time and then put back into the bath for continued electroplating. The substrate to be subjected to electroplating may be removed from one trivalent chromium bath for a certain period of time and placed in another trivalent chromium bath for the sequential electroplating cycle to take place.

The method may further comprise polishing the surface of the chromium-based coating. Polishing or grinding the surface of the chromium-based coating, enables the formation of a smooth top surface. The method may comprise polishing the surface of the chromium-based coating to an Ra-value of below 0.6, or below 0.2. The roughness value (Ra-value) can be determined in accordance with EN ISO 4288:1998. The surface of the chromium-based coating may be polished to a roughness value required by the final application of the object.

The object disclosed in the current specification has the added utility of being well suited for applications wherein hardness of the object is relevant. The materials of the chromium-based coating have the added utility of providing the substrate a hardness suitable for specific applications requiring high durability of the object. The chromium-based coating has the added utility of protecting the underlying substrate from effects caused by the interaction with the environment during use. The chromium-based coating has the added utility of providing a good corrosion resistance. The chromium-based coating further has the added utility of being formed from trivalent chromium, whereby the environmental impact is less than when using hexavalent chromium. Further, the method as disclosed in the current specification has the added utility of being a safer production method for a chromium-based coating than if hexavalent chromium is used. Further, being able to omit the heat treatment of the chromium-containing layer while still providing a chromium-based coating with a high Vickers microhardness value, has the added utility of simplifying the production method and thus beneficially affects the production costs.

EXAMPLES

Reference will now be made in detail to various embodiments, examples of which are illustrated in the accompanying drawings.

The description below discloses some embodiments in such a detail that a person skilled in the art is able to utilize the embodiments based on the disclosure. Not all steps or features of the embodiments are discussed in detail, as many of the steps or features will be obvious for the person skilled in the art based on this specification.

Example 1—Preparing a Chromium-Based Coating on a Substrate

In this example different objects, each comprising a chromium-based coating on a substrate, were prepared.

Firstly, the substrates were pre-treated by cleaning the metal substrates, i.e. CK45 steel substrates, and providing thereon by electroplating and as a part of the substrate a nickel layer having a thickness of about 3-4 μm. Thereafter the substrates were rinsed with water after which the chromium-based coating was formed on the substrate.

| Component | Bath 1 hardness | Bath 2 fast, high deposition rate | Bath 3 broad current density | Bath 4 | Bath 5 | Comparative bath |
|---|---|---|---|---|---|---|
| $Cr^{3+}$ [mol/l] | 0.19 | 0.13 | 0.19 | 0.22 | 0.19 | 0.327-0.577 |
| Molar ratio of $Cr^{3+}$ to formate ion or equivalent amount of carboxylate ions | 0.068 | 0.080 | 0.078 | 0.097 | 0.051 | 0.1-2 |
| $COOH^-$ ions [mol/l] | 2.83 | 1.69 | 2.46 | 2.27 | 3.78 | |
| KBr [mol/l] | 0.23 | 0.23 | 0.23 | 0 | 0.23 | 0.15 |
| Fe [mmol/l] | 0.27 | 0.11 | 0.27 | 0.18 | 0.27 | 0.18 |
| Ni [mmol/l] | 0.0 | 2.98 | 0.53 | 0 | 0.53 | 0.17 |
| water | balance | balance | balance | balance | balance | balance |
| pH | 5 | 4.1 | 5 | 4.9 | 5.0 | 5.3-5.9 |
| Conductivity [mS/cm] | 330 | 310 | 270 | 240 | 330 | |
| Temperature of the bath during electro-plating ° C. | 40 | 65 | 45 | 25 | 46 | 45-60 |

The aqueous electroplating bath was subjected to a normal initial plating, after which it was ready for use.

A chromium-containing coating was deposited on each of the substrates by subjecting the substrates to an electroplating cycles. The electroplating cycle was carried out at for 10 minutes. Then the substrates with the chromium-containing layer were rinsed and polished to an Ra value of about 0.2.

The following properties and parameters of the chromium-based coating of the prepared objects were determined. The results are presented in the below table.

| Properties | Bath 1 | Bath 2 | Bath 3 | Bath 4 | Bath 5 | Comparative bath |
|---|---|---|---|---|---|---|
| Content/amount of Cr; Fe; and Ni (weight-%)* | 97; 3; 0 | 95.4; 0.6; 4.0 | 97; 1.2; 0.6 | | | |
| Hardness ($HV_{0.05}$) | 1750 | 1100 | 1700 | n/a | n/a | 700 |
| Deposition rate (μm/min) | 3.15 | 6.01 | 3.9 | n/a | 3.9 | 1.0 |
| Current density for the above properties ($A/dm^2$) | 150 | 200 | 150 | n/a | 150 | 40 |

*measured with an XRF analyzer that does not show the presence of carbon and scales the results to 100%

Example 2—Effect of the Current Density on the Hardness of the Chromium-Based Coating In this example the effect of the current density during the electroplating was tested. The aqueous electroplating bath was a similar bath as bath 3 above in example 1. The results are presented in the below table.

| Current density ($A/dm^2$) | Crystal size (nm) | Hardness (HV) | Amount of Ni (weight-%)* | Amount of Fe (weight-%)* |
|---|---|---|---|---|
| 50 | 4 | 900 | 1.9 | 2.7 |
| 70 | 8 | 890 | 1.6 | 2.0 |
| 120 | 12.4 | 1418 | 1.5 | 1.6 |
| 155 | 11.9 | 1394 | 1.2 | 1.5 |

*measured with an XRF analyzer

It is obvious to a person skilled in the art that with the advancement of technology, the basic idea may be implemented in various ways. The embodiments are thus not limited to the examples described above; instead, they may vary within the scope of the claims.

The embodiments described hereinbefore may be used in any combination with each other. Several of the embodiments may be combined together to form a further embodiment. An object, a method, or an aqueous electroplating bath disclosed herein, may comprise at least one of the embodiments described hereinbefore. It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items. The term "comprising" is used in this specification to mean including the feature(s) or act(s) followed thereafter, without excluding the presence of one or more additional features or acts.

The invention claimed is:

1. A method for producing an object comprising a chromium-based coating on a substrate, wherein the method comprises:

depositing a chromium-containing layer on the substrate by subjecting the substrate to at least one electroplating cycle from an aqueous electroplating bath, wherein each of the at least one electroplating cycle is carried out at a current density of 50-300 Amperes per 1 square decimeter ($A/dm^2$) and at a deposition rate of 1.5-10 micrometers (μm)/minute, and wherein the aqueous electroplating bath comprises:

trivalent chromium cations in an amount of 0.12-0.3 mole per liter (mol/l), iron cations and/or nickel cations in an amount of 0.18-6.16 millimoles per liter (mmol/l), and carboxylate ions in an amount of 1.22-7.4 mol/l, and wherein the molar ratio of trivalent chromium cations to the carboxylate ions is 0.015-0.099, and wherein the pH of the aqueous electroplating bath is 2-6, to produce a hard chromium-based coating having a Vickers microhardness value of 900-2000 HV without subjecting the deposited chromium-containing layer to a heat treatment, and wherein the chromium-based coating does not contain chromium carbide.

2. The method of claim 1, wherein the temperature of the aqueous electroplating bath is kept at 25-70° C. during the at least one electroplating cycle.

3. The method of claim 1, wherein each of the at least one electroplating cycle is continued for 1 minute-4 hours.

4. The method of claim 1, wherein the electroplating cycle is carried out at a current density of 80-250 A/dm$^2$.

5. An aqueous electroplating bath:

trivalent chromium cations in an amount of 0.12-0.3 moles per liter (mol/l), iron cations and/or nickel cations in an amount of 0.18-6.16 millimoles per liter (mmol/l), and carboxylate ions in an amount of 1.2-7.4 mol/l, and wherein the molar ratio of trivalent chromium cations to the carboxylate ions is 0.015-0.099, wherein the pH of the aqueous electroplating bath is 2-6; and wherein the conductivity of the aqueous electroplating bath is 160-400 milli-siemens per centimeter (mS/cm).

6. The aqueous electroplating bath of claim 5, wherein the molar ratio of trivalent chromium cations to the carboxylate ions is 0.015-0.09.

7. The aqueous electroplating bath of claim 5, comprising bromide ions in an amount of 0.15-0.3 mol/l.

8. The aqueous electroplating bath of claim 5, comprising ammonium ions in an amount of 0.18-1.5 mol/l.

9. The aqueous electroplating bath of claim 5, wherein the source of carboxylate ions is formic acid.

10. The aqueous electroplating bath of claim 5, wherein the pH of the aqueous electroplating bath is 3-5.5.

11. The aqueous electroplating bath of claim 5, wherein the conductivity of the aqueous electroplating bath is 200-350 mS/cm.

* * * * *